US007896329B2

(12) United States Patent
Lappok et al.

(10) Patent No.: US 7,896,329 B2
(45) Date of Patent: Mar. 1, 2011

(54) WASTE BLOWER FOR A PAPER SHEET PUNCHING AND EMBOSSING MACHINE

(75) Inventors: Reinhard Lappok, Dormagen (DE); Peter Palmen, Monchengladbach (DE); Guido Zanders, Monchengladbach (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 162 days.

(21) Appl. No.: 11/756,348

(22) Filed: May 31, 2007

(65) Prior Publication Data

US 2007/0296142 A1 Dec. 27, 2007

(30) Foreign Application Priority Data

Jun. 12, 2006 (DE) ..... 10 2006 027 124

(51) Int. Cl.

| | |
|---|---|
| ***B42B 2/00*** | (2006.01) |
| ***B42B 2/02*** | (2006.01) |
| ***B65H 5/30*** | (2006.01) |
| ***B65H 39/00*** | (2006.01) |
| ***B65H 33/04*** | (2006.01) |

(52) U.S. Cl. ..... 270/58.07; 270/58.26; 270/58.01

(58) Field of Classification Search ..... 270/58.26, 270/58.01, 58.07

See application file for complete search history.

(56) References Cited

U.S. PATENT DOCUMENTS

| | | | | |
|---|---|---|---|---|
| 4,047,474 | A | 9/1977 | Lang | |
| 5,154,689 | A | 10/1992 | Modoux et al. | |
| 5,230,453 | A * | 7/1993 | Meschi | 225/100 |
| 5,348,285 | A * | 9/1994 | Huser | 271/183 |
| 5,419,224 | A | 5/1995 | Gamperling et al. | |
| 5,971,394 | A * | 10/1999 | Kida et al. | 271/303 |
| 2004/0149097 | A1 * | 8/2004 | Bayer et al. | 83/100 |

FOREIGN PATENT DOCUMENTS

| | | | |
|---|---|---|---|
| DE | 609315 | C | 2/1935 |
| DE | 1045778 | B | 12/1958 |
| DE | 25 44 139 | A1 | 4/1976 |
| DE | 102 59 556 | A1 | 7/2004 |
| DE | 20 2004 018 763 | U1 | 4/2005 |
| DE | 10 2004 058 601 | A1 | 8/2005 |
| EP | 0451568 | A | 10/1991 |
| EP | 05 86 876 | A1 | 3/1994 |
| EP | 1018412 | A2 * | 7/2000 |

OTHER PUBLICATIONS

Official Communication for German Application No. 10 2006 027 124.6; mailed on Jan. 11, 2007.

Official communication issued in the counterpart German Application No. 07108100.4, mailed on Aug. 2, 2007.

* cited by examiner

*Primary Examiner* — Gene Crawford
*Assistant Examiner* — Yolanda Cumbess
(74) *Attorney, Agent, or Firm* — Keating & Bennett, LLP

(57) ABSTRACT

A sheet punching and embossing machine includes revolving gripper cars with which a gripping margin of a sheet is grasped by grippers disposed on the gripper car so as to move the sheet through the machine, a punching station in which the gripping margin can be separated from the sheet, a delivery station in which the gripping margin can be further separated from the sheet, and an ejection station in which the gripping margin can be ejected from the gripper. The ejection station includes a blower which directs a current of air at the gripping margin.

8 Claims, 3 Drawing Sheets

WASTE BLOWER FOR A PAPER SHEET PUNCHING AND EMBOSSING MACHINE

BACKGROUND OF THE INVENTION

1. Field of the Invention

The present invention relates to a paper sheet punching and embossing machine.

2. Description of the Related Art

In known sheet punching and embossing machines, which are used for punching, tearing off, embossing and delivery of sheets of paper, cardboard, and other stock materials, it is known how to move the sheets with gripper cars into the individual stations of the machine. Grippers are secured on the cars and grab the sheets at a front end, while the gripper cars are moved on endless chains through the machine. With this type of movement of the sheets through the machine, continuous operation in the individual stations of the machine arranged one after the other is obtained. Since an impression of the gripper on the final punched and/or embossed sheet is undesirable, the marginal region at which the gripper grabs the sheet is separated from the finished sheet. This gripping margin is usually discarded at the end of the machine. Many different devices are known for separating the gripping margin from the sheet.

EP 0 586 876 B1 discloses a known a device in which a revolving cutting cylinder includes spaced apart blades, and a suction and blowing mechanism is arranged between the spaced blades. After the waste strip is separated by the blades arranged on the cylinder, the waste strip is held by a partial vacuum against the cylinder and transported away. The actual discarding of the waste strip occurs when, first, the suction is replaced by a blowing, and second, an exhaust hood is arranged above the cylinder, so that the waste strip is blown away from the cylinder by the blown air and attracted by the suction air of the exhaust hood.

DE 102 59 556 A1 discloses a known sheet punching and embossing machine of this kind, in which gripper cars are secured to revolving chains, and sheets are pulled through a sheet punching and embossing machine by grippers. The sheet punching and embossing machine includes a punching mechanism, a tear-off mechanism and a delivery mechanism. In a discarding station connected downstream, a gripping margin separated from the sheet is discarded. Discarding occurs by opening the grippers of the car, such that the gripping margin is dropped. To facilitate discarding of the gripping margin, brushes or wiper fingers are provided in the machine frame between the grippers.

Depending on the type of sheet being processed in the machine, a larger or smaller gripping margin will be wasted. A gripping margin is typically between two centimeters and five centimeters. Additionally, the gripping margin may also consist of a full-size sheet, from which the copy has been punched out. This gripping margin including a margin several centimeters thick, having the size of the complete sheet, also must be transported to the delivery station.

Especially when the gripping margin corresponds to a full-size sheet, the grip opening cam at the discarding station has to be adjusted to the gripping margin in order to eliminate the gripping margin as waste from the machine. For this, the machine must be retrofitted. With a normal gripping margin, one grip opening cam is attached in a first position and with a gripping margin equal to the size of the sheet a second grip opening cam is attached in a second position. For this, the ejection point has to be adjusted in a stepless manner, depending on the machine speed and the paper weight. Especially in the case of a gripping margin equal to the size of the sheet, this results in retrofitting costs, on the one hand, and a reduction in the machine speed, on the other, in order to eject a gripping margin equal to the size of the sheet from the machine.

SUMMARY OF THE INVENTION

To overcome the problems described above, preferred embodiments of the present invention provide a sheet punching and embossing machine in which a costly retrofitting of the machine is avoided, reliable ejection of different gripping margins is accomplished at maximum machine performance and with low cost and simple structural elements.

According to preferred embodiments of the present invention, a blower blows air towards an ejection station so that a directed current of air acts on the gripping margin. According to preferred embodiments of the present invention, a sheet punching and embossing machine achieves reliable ejecting of the gripping margin without any retrofitting of the grip opening cam. Thus, ejection of the gripping margin is achieved at low cost.

In a preferred embodiment of the present invention, several blowers are secured next to one another across the entire width of the ejection station, so that a blower strip is defined. This ensures that gripping margins of different sizes can be reliably ejected over the entire width of the ejection station.

Preferably, a conveyor belt is provided in the ejection station below the movement trajectory of the gripper car. This facilitates the ejection of especially large gripping margins.

In another preferred embodiment of the present invention, the blower is secured inside the circular path of the gripper car in the machine frame. This ensures that the current of air can be accurately directed towards the conveyor belt.

In another preferred embodiment, a suction blower is secured outside the circular path of the gripper car in the machine frame. With the suction blower, the gripping margin is reliably sucked out of the gripper car.

The use of a blower as a blowing and/or sucking blower produces a defined ejecting of the gripping margin because during the ejection of a long gripping margin, the air is transformed by the blower (either sucking or blowing) into a directed current of air. This enables a secure delivery of the gripping margin on a waste belt disposed beneath the path of the gripper car.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
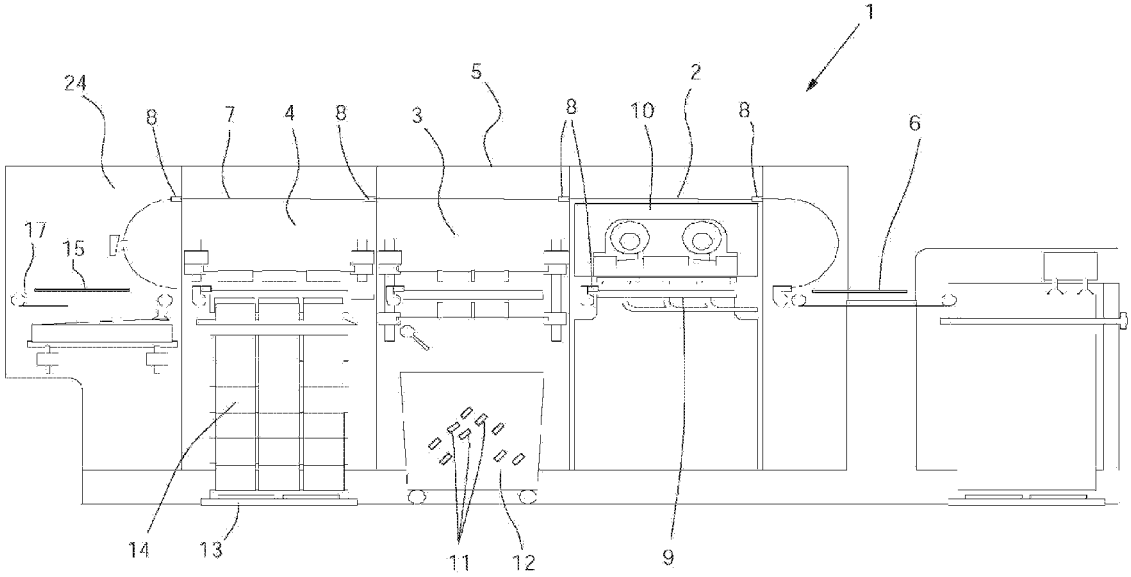
FIG. 1 is the basic layout of a sheet punching and embossing machine.

FIG. 1 shows the basic layout of a sheet punching and embossing machine 1 for punching, tearing off, embossing and delivery of sheets of paper, cardboard, or other stock materials. The punching and embossing machine 1 includes a punching mechanism 2, a tear-off mechanism 3, a delivery mechanism 4 and an ejection station 24, which are supported and enclosed in a common machine housing 5.

The sheets 6 are gripped in a gripping margin at their front edge by gripper rods 8 attached to revolving chains 7 and transported intermittently through the various stations 2, 3, 4 and 24 of the punching and embossing machine 1.

The punching station 2 includes a lower table 9 and an upper table 10. The lower table 9 is securely mounted in the machine frame and provided with a counterplate for the punching blade. The upper table 10 is mounted so as to be movable vertically up and down.

The gripper rod 8 transports the sheet 6 from the punching and embossing station 2 into the tear-off station 3, which includes tear-off tools. In the tear-off station 3, the unneeded scraps from the sheet 6 are torn off by the tear-off tools in a downward direction, so that the scraps 11 fall into a container cart 12 disposed under the station.

From the tear-off station 3, the sheet is transported to the delivery station 4, where either the sheet is merely stacked or where separation of individual copies is performed at the same time. The delivery station 4 may also include a pallet 13 on which the individual sheets are stacked in the form of a pile 14, so that after a particular stacking height is reached, the pallets with the sheets stacked thereon can be transported away from the punching and embossing machine 1.

As shown in FIG. 1, the chains 7 include several gripper cars 8, so that several sheets 6 can be processed in the various stations 2, 3, 4 and 24 at the same time.

At the delivery mechanism 4, the gripping margin (not shown) is separated from the sheet 6. At the ejection station 24, the separated gripping margin 15 is ejected and hauled away by a conveyor belt 17. The ejecting is usually performed by opening of the gripper 8 or by a combined opening of the gripper 8 and a brush 21 (see FIG. 2) arranged next to the grippers 8, which eject the gripping margin 15 from the gripper car in the event that the gripping margin 15 remains stuck in the gripper car 8 when the gripper 8 is open.

Figure 2:
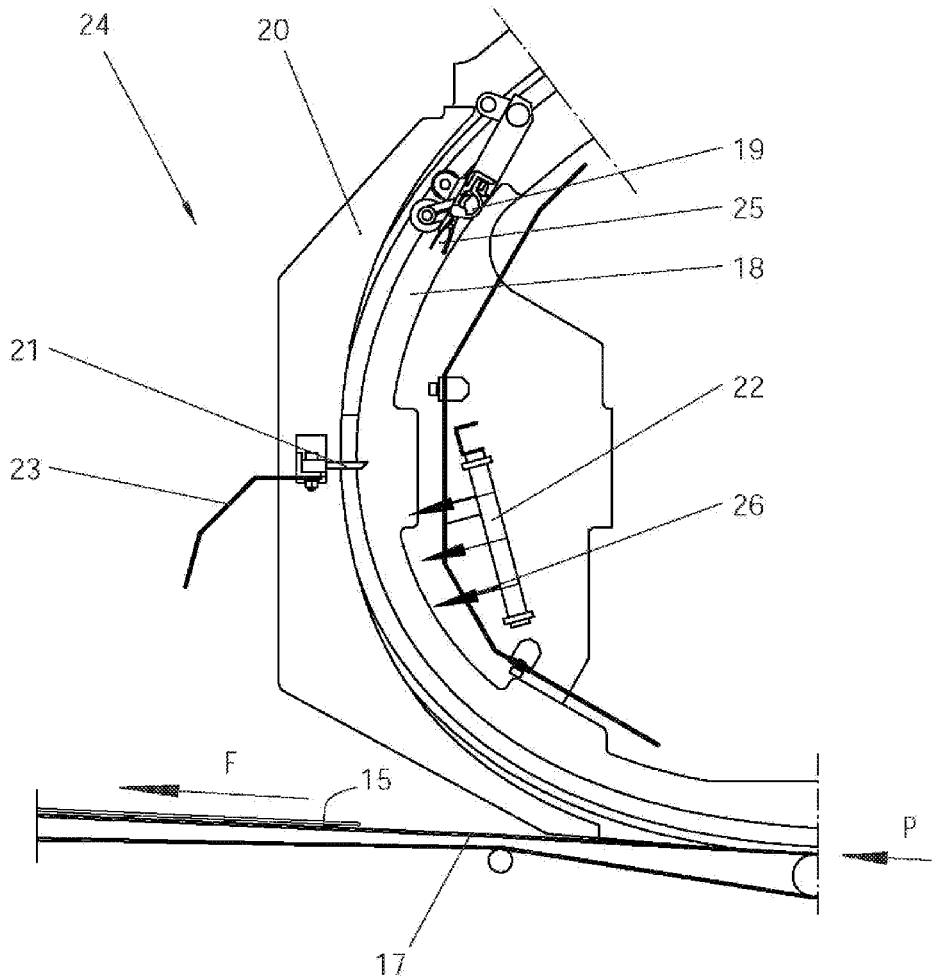
FIG. 2 is a detailed side view in the region of an ejection station including a blowing blower.

FIG. 2 shows a side view of a sheet punching and embossing machine according to a preferred embodiment of the present invention in the region of the ejection station 24 at which the gripping margin 15 is discarded. As noted above, the dimensions of the gripping margin may correspond to those of the entire sheet. FIG. 2 shows a conveyor belt 17, which is secured in the machine frame 20 underneath a circular path 18 of the gripper car 19. The portion of the sheet punching and embossing machine defining the circular path 18 for the gripper car 19 is a portion of the machine frame 20. Approximately in the middle of the circular path 18, a wiping brush 21 is mounted in the machine frame 20. Inside the circular path 18, a blower 22 is secured in the machine frame 20. In order to intensify the directed current of air, a baffle 23 is disposed beneath the wiping brush 21. In addition to the benefit of a direction air flow, the baffle 23 ensures a directed ejection of the gripping margin 15.

In a preferred embodiment of the present invention, the blower or blowers 22 are secured in the machine frame 20 and are distributed uniformly across the entire width of the machine, at substantially regular intervals from each other. For example, five blowers 22 may be secured in the machine frame 20 and distributed next to each other across the width of the machine. The blowers are preferably speed-regulated, and the speed is regulated as a function of the gripping margin and the paper weight. In addition, the machine speed is factored into the automatic control process. Thus, the current of air and thus the force exerted on the waste paper is continuously regulated as a function of the machine speed. By providing a blower strip 22, a constant force is produced in the direction of the waste paper belt 17. This has the effect of enabling the machine speed to be increased by 20% without retrofitting the grip opening cams. Furthermore, it is beneficial for design considerations that the blower strip may be installed in a sheet of metal of the ejection station, also known as the delivery.

In the direction of the arrow P, the gripping margin 15 is transported to the indicated delivery 24, where the gripper 25 of the gripper car 19 opens and thus releases the gripping margin 15. Due to the directed air flow, indicated here by the arrows 26, the ejecting of the gripping margin 15 is facilitated. Due to the blower strip 22, a constant force is produced in the direction of the waste belt 17. This enables even long gripping margins to be disposed on the conveyor belt 17 with no problems and delivered out of the sheet punching and embossing machine. The conveyor belt 17 moves the ejected gripping margins 15 in the direction of the arrow F from the machine. Another benefit resulting from a blowing blower 22 or a blower strip 22 is that the waste stream can be more easily guided with relatively small distances between the wastes.

Figure 3:
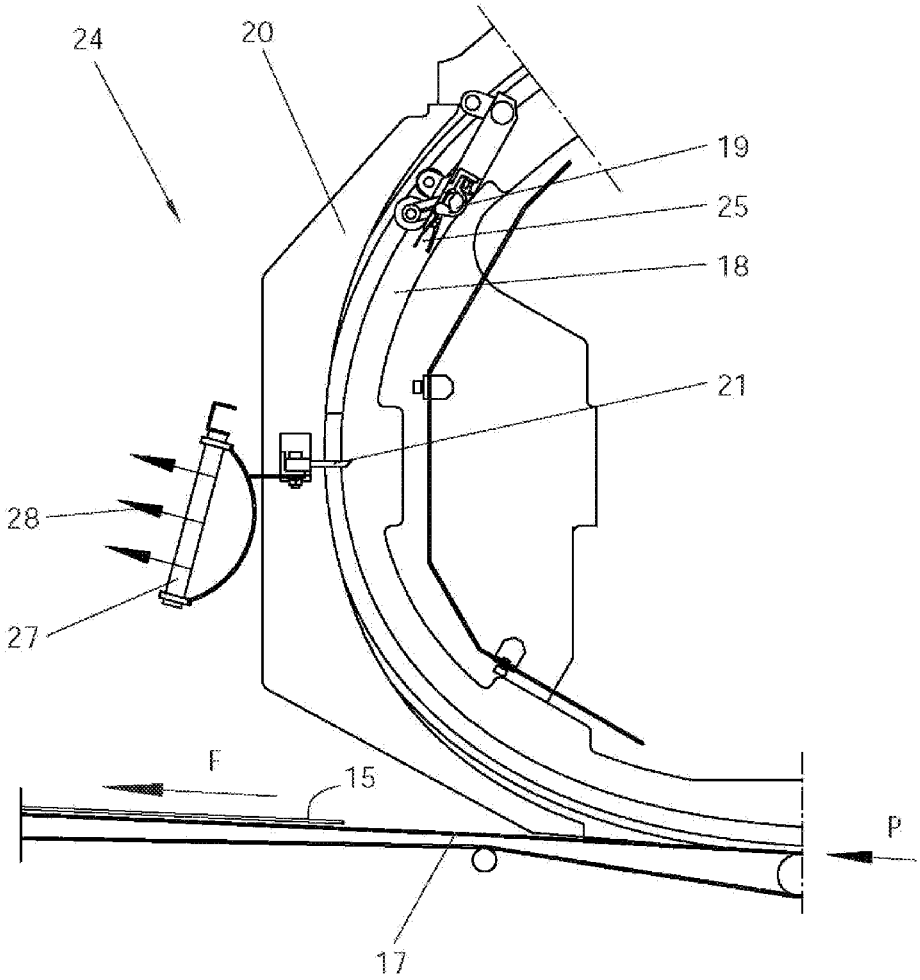
FIG. 3 is a detailed side view in the region of an ejection station with a sucking blower.

According to preferred embodiments of the present invention, it is possible to use a sucking blower 27, in addition to a blowing blower 22, as shown in FIG. 3. The gripping margin 15 is not forced out from the gripper car 19 by the blower 22, but instead is pulled out from the grippers 25 of the car 19 by the directed air flow 28 of the blower 27. This provides a benefit if, for example, existing machinery needs to be modified or retrofitted with a blower strip 27. Since the blower strip 27 is mounted behind the circular path 18 of the gripper car 19, and the blower strip 27 can be easily installed.

It is noted that a sucking blower 27 and a blowing blower 22 may be used together and at the same time, depending on the weight of the sheet being handled.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A sheet punching and embossing machine comprising:

a revolving gripper car including a gripper attached thereto, the gripper being arranged to grasp a sheet in a gripping margin thereof and move the sheet through the machine;

a punching station arranged to separate the gripping margin from the sheet;

a tear-off station arranged to tear off and discard punched scraps from the sheet;

a delivery station arranged to further separate the gripping margin from the sheet; and an ejection station arranged to eject and discard the gripping margin from the gripper; wherein the ejection station includes at least one blower which directs a current of air at the gripping margin;

both the gripping margin and the punched scraps are removed from the sheet and discarded;

the at least one blower includes a plurality of blowers arranged next to one another across substantially an entire width of the ejection station so as to define a blower strip; and the plurality of blowers are speed-regulated blowers whose speed is regulated as a function of the shape and size of the gripping margin and the paper weight.

2. The sheet punching and embossing machine according to claim 1, wherein the plurality of blowers are disposed at substantially equal intervals across substantially the entire width of the ejection station.

3. The sheet punching and embossing machine according to claim 1, wherein a conveyor belt is disposed in the ejection station below a movement trajectory of the gripper car.

4. The sheet punching and embossing machine according to claim 3, wherein the gripper car is guided along a circular path across the conveyor belt.

5. The sheet punching and embossing machine according to claim 4, wherein the blower is secured inside the circular path of the gripper car in the machine frame, and the blower is operated as a blowing blower, the current of air being directed in a direction of the conveyor belt.

6. The sheet punching and embossing machine according to claim 4, wherein the blower is secured outside the circular path of the gripper car in the machine frame, and the blower is a sucking blower, the current of air being directed in a direction away from the circular path of the gripper car.

7. The sheet punching and embossing machine according to claim 1, wherein at least one of each of the punching station, the tear-off station, the delivery station and the ejection station are arranged in the machine in this order in a transport direction of the sheet.

8. The sheet punching and embossing machine according to claim 1, wherein the speed of the speed-regulated blowers is further regulated as a function of a transport speed of the sheet through the machine.

* * * * *